US005979680A

United States Patent [19]

Farside

[11] Patent Number: 5,979,680

[45] Date of Patent: Nov. 9, 1999

[54] PUSH TAB CAP AND LOCKING TAB VIAL ASSEMBLY

[75] Inventor: Nicholas C. Farside, East Petersburg, Pa.

[73] Assignee: Kerr Group, Inc., Lancaster, Pa.

[21] Appl. No.: 08/949,140

[22] Filed: Oct. 10, 1997

[51] Int. Cl.[6] ..... B65D 55/02

[52] U.S. Cl. ..... 215/216; 215/211; 215/224; 215/213; 215/354; 215/320; 215/321; 215/45

[58] Field of Search ..... 215/211, 216, 215/224, 217, 221, 341, 344, 354, 213, 206, 43, 45, 305, 320, 321; 220/23.9, 23.91, 281

[56] References Cited

U.S. PATENT DOCUMENTS

| | | | |
|---|---|---|---|
| 2,808,090 | 10/1957 | Casaline | 220/23.91 X |
| 3,642,161 | 2/1972 | Stroud . | |
| 3,720,342 | 3/1973 | Vercillo . | |
| 4,171,057 | 10/1979 | Gach . | |
| 4,298,036 | 11/1981 | Horvath | 215/224 X |
| 4,444,326 | 4/1984 | Musel | 215/211 X |
| 4,844,073 | 7/1989 | Pohler | 215/321 X |
| 5,230,433 | 7/1993 | Hamilton et al. | 215/216 X |
| 5,383,564 | 1/1995 | Hamilton et al. | 215/216 X |
| 5,706,963 | 1/1998 | Gargione | 215/217 X |

*Primary Examiner*—Stephen K. Cronin
*Assistant Examiner*—Robin A. Hylton
*Attorney, Agent, or Firm*—John J. Skinner, Jr.; Kenyon & Kenyon

[57] ABSTRACT

A child-resistant adult-friendly prescription storage vial is presented with an over-cap which can only be removed from the vial by first orienting the cap at a particular point on the vial and then depressing a pair of push-tabs on the cap. When the cap is properly oriented the push-tabs mechanically operate a pair of locking tabs on the vial which hold the cap in place. The locking tabs are designed so that an extended lip on the tab interlocks with a slit on the cap and can only be removed from the slit when the push-tabs on the cap are manually operated.

9 Claims, 7 Drawing Sheets

PUSH TAB CAP AND LOCKING TAB VIAL ASSEMBLY

FIELD OF THE INVENTION

The present invention relates to a child-resistant adult-friendly cap and vial assembly for the storage of prescription pills and the like, and more particularly to a child-resistant adult-friendly vial having an over-cap which cannot be removed without first aligning the cap to a point on the vial and then mechanically depressing a pair of push-tabs on the cap to remove a pair of locking tabs on the vial from a pair of slits on the cap.

BACKGROUND INFORMATION

The safe storage of prescription medications, such as pills and the like, has been problematic in the past, so much so, that the United States Federal government enacted safety laws to govern such storage containers. As a large portion of the population, in particular the elderly and the infirm, take these prescription medications for one ailment or another, safe storage of their prescriptions is necessary. It has been an unfortunate result that until now many of the storage containers have not been safe. Young children and toddlers have been able to gain access to the contents of many of the containers and have suffered serious illness and even death as a result.

Thus, there has long been a need for storage containers which are child resistant yet, at the same time, adult friendly. U.S. Pat. No. 4,171,057, to Gach, relates to a child-resistant medicine vial. The medicine vial according to Gach has a cap with two concentric skirts, one inside of the other. The inside skirt tightly fits into an opening of the container, while the outside skirt rides outside of the neck of the container. The outside skirt has a lug on an inner surface which, when the outside skirt is squeezed, rides up on an upwardly extending ramp on a flange encircling the neck of the container just below the outside skirt. Thus when the cap is squeezed and turned, the lug rides up the ramp pulling the inner skirt out of the neck of the container. However, it may be possible to remove the cap from the container if sufficient leverage were able to be obtained between the outer skirt and the flange on the neck of the container, especially so if the cap were not placed fully onto the container.

U.S. Pat. No. 3,642,161, to Stroud, relates to a safety lid for flanged containers. A two-piece cap assembly acts as a safety lid for the container. The first piece, a base cap, has a skirt which fits inside of the container and a skirt which fits outside of the container. The skirt which fits outside of the container has one or more movable locking tabs which engage the flange on the container. The second piece of the safety lid is a top cap rotatably mounted on the base cap. The top cap has one or more recessed edges around its peripheral edge, so that the movable locking tabs on the base cap may only be pressed into the recesses. When the locking tabs are manipulated in this manner they disengage from the flange on the container thereby allowing the two-piece cap to be removed from the container. Manufacturing of the two-piece cap requires more material and tooling, and as such, is more expensive to manufacture. Furthermore, the top cap may break off of the base cap, thereby allowing the locking tabs to be manipulated at any circumference point around the container and may be accidentally opened by children.

U.S. Pat. No. 3,720,342, to Vercillo, relates to a closure associated with a container. The closure has a peripheral skirt with an annular lip about its lower circumference which fits into an annular groove on a container. The closure is constructed of a resilient material with a slow return rate, so that as the closure is pressed or screwed onto the container, the lip slides over an outer portion of the groove until seated within the valley of the groove itself. In order to remove or unscrew the closure from the container, the closure is first pressed downward over a portion of the container having an outward slope such that the closure lip is disengaged from the groove. Because of the slow rate of return of the closure material, the closure can be removed from the container without the lip re-engaging the groove. With age and as the result of the wear and tear of the repeated flexing, however, the return rate of the material may give to such a point that the normal rest position of the lip is outside of the groove, thereby defeating the purpose of the safety closure.

Due to the industry's failure to provide a suitable storage cap and vial for prescription medications and the like, capable of being both child-resistant and adult-friendly and not subject to breakage, normal wear and tear of its components, or prohibitively expensive to manufacture, there remains a need for the development of one.

SUMMARY OF THE INVENTION

Accordingly, it is an object of the present invention to provide a closure and container assembly that is child resistant yet adult friendly in the form of a cap and vial for the storage of prescription medications and the like.

Another object of the present invention is to provide a vial with a safety cap which can be quickly placed in position and locked on the vial so as to prevent unintended access to the contents thereof, such as by children, but which can be easily manipulated to allow for the removal of the cap by an adult.

Further, it is another object to present a child resistant vial which is easily and cheaply manufacturable.

To achieve the foregoing and further objectives, and in accordance with the purposes of the present invention, as embodied and broadly described herein, the present invention is directed to a child-resistant adult-friendly vial for the storage of prescription medications and the like. Thus, according to an embodiment of the present invention, the vial is constructed as such so that an over-cap is locked into place by one or more locking tabs on the vial which engage one or more semi-annular slits cut into or through the over-cap. In explanation, as the cap is pressed onto the vial, a lip extending outwardly on an upper end of the locking tab comes into contact with the inner surface of an annular skirt of the cap and deflects the entire locking tab. The lip of the locking tab then snaps into the semi-annular slit cut into or entirely through the annular skirt of the cap when the position of the slit is reached. Thus the cap is locked onto the vial as into each one of the annular slits fits a lip on the corresponding locking tab.

The cap can only be removed from the vial by depressing one or more push-tabs on the cap. The push-tabs on the cap must first be aligned so that they correspond in location to the locking tabs. This is achieved by rotating the cap until the cap is in position, as indicated by corresponding markings on the cap and vial. When the cap is so aligned on the vial, the push-tabs are manually depressed. The manual depression of the push-tabs causes the push-tabs to thus push the locking tabs so that the lip of the locking tabs disengages itself from the slits in which they are fitted. When the lips of the locking tabs are removed from the slits the cap may be lifted off of the vial.

The present invention and its features and advantages will become more apparent from the following detailed description with reference to the accompanying drawings.

DETAILED DESCRIPTION

Figure 1:
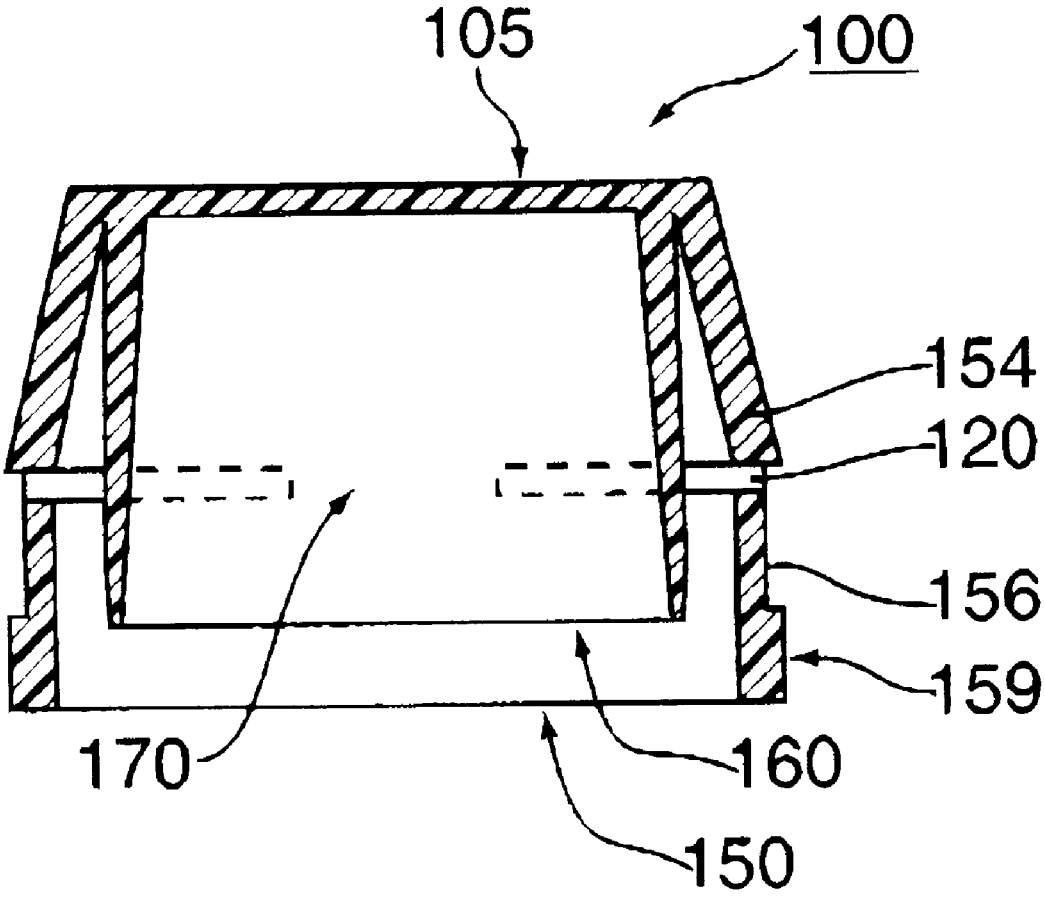
FIG. 1 illustrates a cut-away side view of the over-cap according to an embodiment of the present invention.

FIGS. 1 to 7 show a child-resistant adult-friendly cap and vial assembly according to the present invention. An over-cap 100 is assembled onto a vial 200 by sliding the cap 100 over and around an outer flange 250 on the vial 200. The cap 100 is locked into place by an annular lip 220, extending from a locking tab 260 on the vial 200, which fits into a annular slit 120 in the cap 100. The cap 100 cannot be removed from the vial 200 without first manipulating a push-tab 110 on the cap 100 which in turn depresses the locking tab 260 on the vial 200 thereby removing the annular lip 220 from the annular slit 120.

Figure 3:
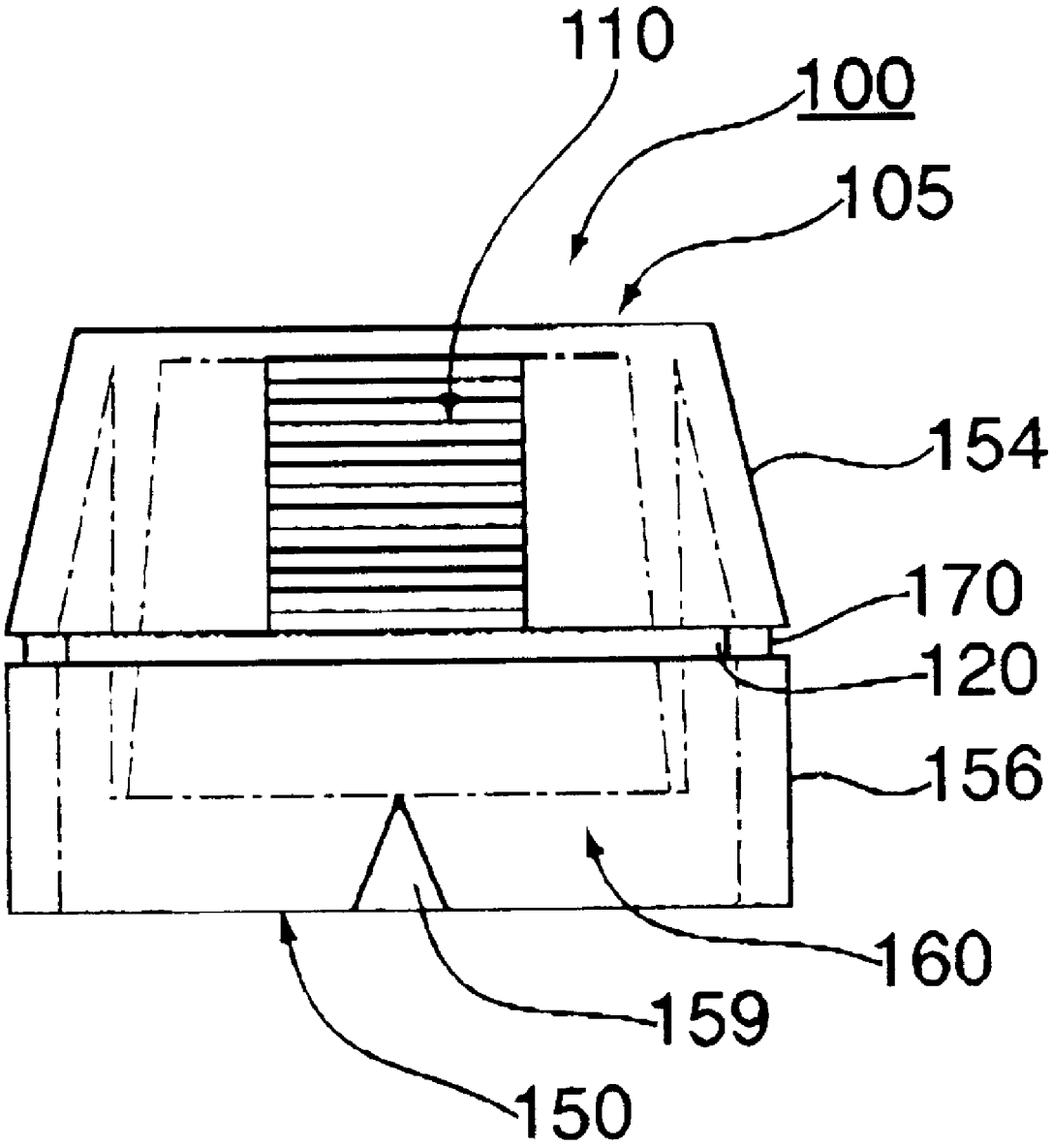
FIG. 3 illustrates a frontal view of the over-cap according to an embodiment of the present invention.

Referring to FIGS. 1 and 3, the cap 100 includes a base 105 which preferably has an inner annular skirt 160 and an outer annular skirt 150 depending therefrom. The inner annular skirt 160 depends preferably vertically down from an inner surface of the base 105 and preferably tapers from a thicker end near the base 105 to a thinner end away from the base. The inner annular skirt 160 preferably is constructed to fit closely inside the inner circumference of the vial 200, when the cap 100 is placed on the vial 200, without unduly hindering the rotatability of the cap 100 on the vial 200. This close fit creates an air-tight and moisture-tight plug seal to prevent accidental spillage of the vial 200 contents.

The outer annular skirt 150 preferably is shaped so that it depends outwardly and downwardly from the base 105, and as such has a first part 154 and a second part 156. The first part 154 and the second part 156 are integrally connected by at least one bridge 170 between the ends of the at least one annular slit 120. Preferably the outer annular skirt 150 will have two annular slits 120 with two bridges 170 placed 180 degrees apart from each other around the cap 100 circumference.

The first part 154 of the outer annular skirt 150 preferably extends in a direction outwardly and downwardly from the base 110, thus forming an angle from the base 105, to a point approximately half of the distance of the entire length of the outer annular skirt 150. Thus the first part 154 preferably is long enough to allow for a good working surface for the fingers of a user to grip and squeeze the cap 100. The first part 154 has a push-tab 110, cut out of its circumference, which is integrally and flexibly connected to the first part 154 near the base 105 of the cap 100. The push-tab 110 can thus be flexibly depressed towards the inner annular skirt 160 by being manually manipulated.

The second part 156 extends preferably vertically downward from the first part 154 and has the annular slit 120 horizontally cut through its surface. The annular slit 120 is cut in a direction parallel to the circumference of the second part 156 of the outer annular skirt 150, preferably is centered on the position of the push-tab 110, and preferably is long enough in total length to allow the cap 100 to be rotated. According to various embodiments, there may be more than one annular slit 120. The second part 156 of the outer annular skirt 150 also includes an indicator 159 centrally located so that it is beneath the position of the push-tab 110 on the first part 154. The indicator 159 preferably is triangularly shaped, and for easy visualization can either be raised from or cut-out from the surface of the second part 156.

Figure 2:
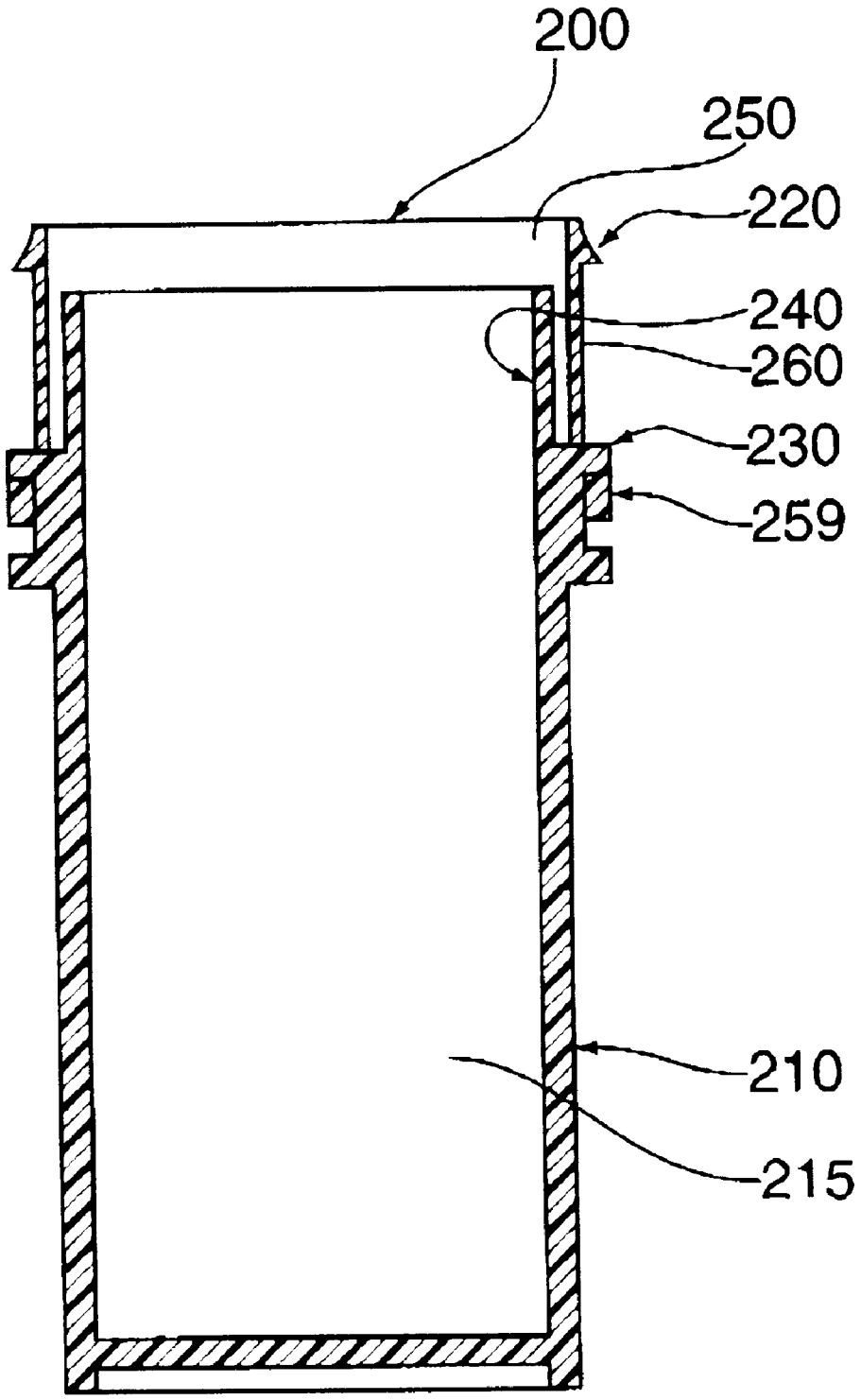
FIG. 2 illustrates a cut-away side view of the vial according to an embodiment of the present invention.
Figure 4:
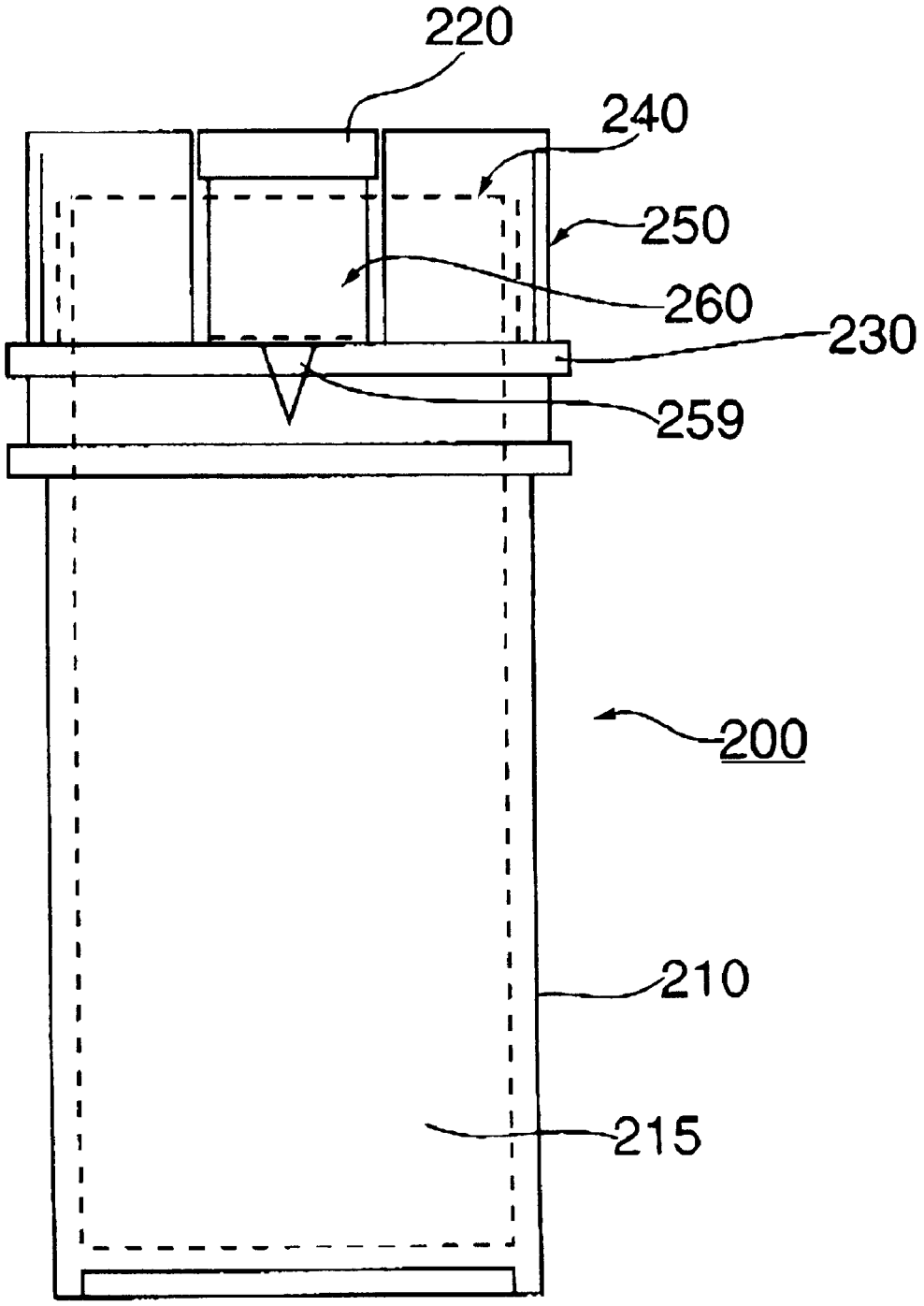
FIG. 4 illustrates a frontal view of the vial according to an embodiment of the present invention.

Referring to FIGS. 2 and 4, vial 200 has a receptacle portion 210 defining a chamber 215 for storage of contents. Vial 200 can store a variety of contents, such as prescription medicines, pills, liquids and the like. Integrally attached to the receptacle portion 210 is an annular platform 230. The annular platform 230 preferably extends horizontally outward in sufficient length from an outer surface of the receptacle portion 210 such that when the cap 100 is placed onto the vial 200, the outer edge of the annular platform 230 is flush with the outer surface of the second part 156 of the cap 100. In other words a smooth uninterrupted surface is preferably created between the two. More than one annular platform may be provided.

From the annular platform 230 an inner annular flange 240 defines an opening into the chamber 215 of the receptacle portion 210. The inner annular flange 240 extends upwards preferably far enough in length to allow for the air-tight, moisture-tight plug seal with the inner annular skirt 160 of the cap 100.

At a position radially outward of inner annular flange 240, and situated on and integrally connected to the annular platform 230, is an outer annular flange 250 extending vertically upwards from the annular platform 230. The outer annular flange 250 is spaced far enough apart from the inner annular flange 240 to allow for adequate flexibility of the locking tab 260. Cut-out from the circumference of the outer annular flange 250 is the locking tab 260 which has, preferably on an upper portion, the annular lip 220 extending horizontally outwards therefrom. An indicator 259, preferably triangularly shaped, extends vertically downwards from the annular platform.

The vial 200, annular platform 230, inner annular flange 240 and outer annular flange 250 can be manufactured as a unitary structure, and can be manufactured from materials such as plastic or glass, or other suitable materials. The preferred materials are plastics such as polyethyleneterathilate (PET) and polypropylene (PP).

Figure 5:
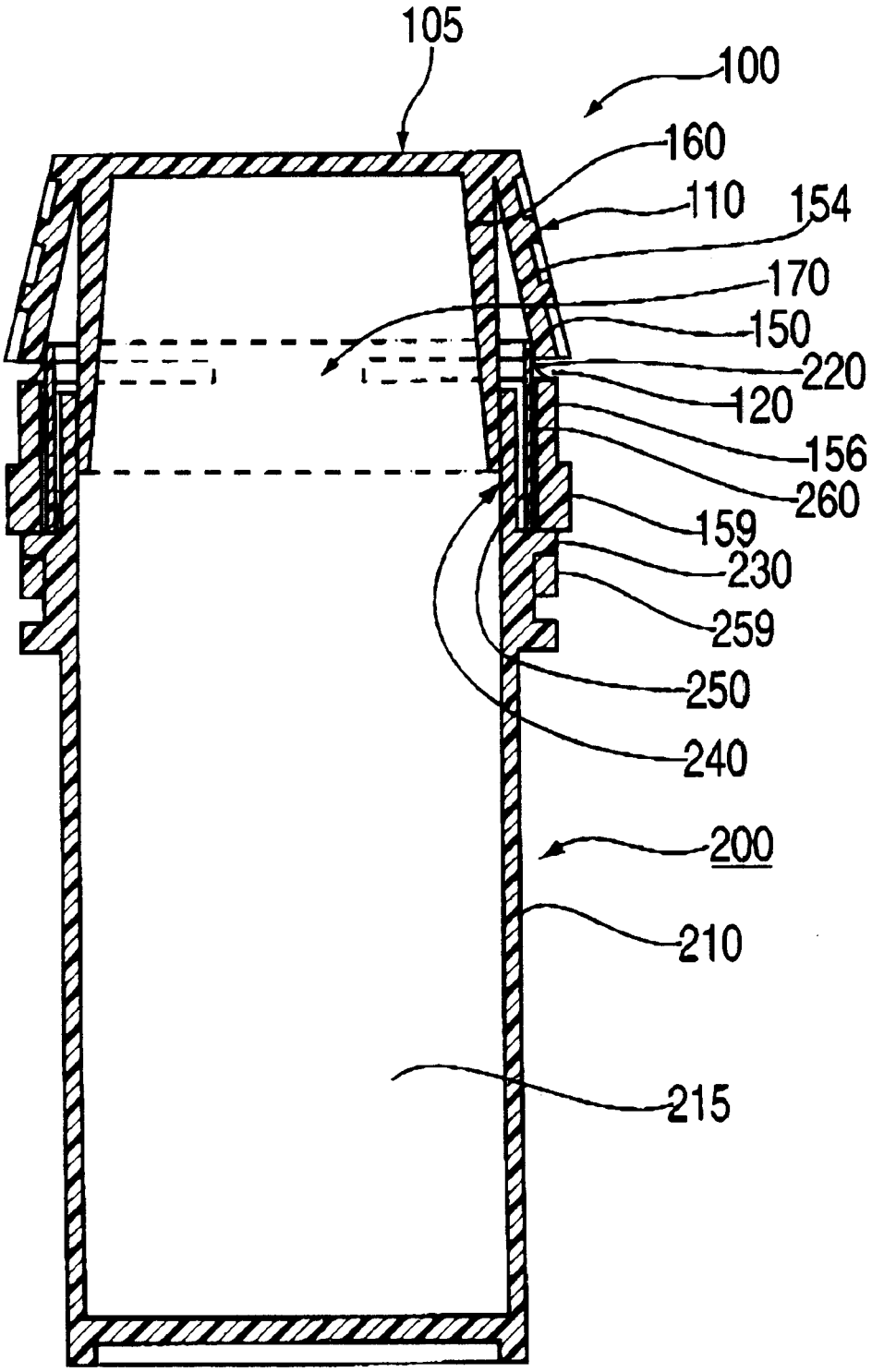
FIG. 5 illustrates a cut-away side view of the cap assembled onto the vial according to an embodiment of the present invention.

Referring to FIG. 5, the cap 100 is positioned on the vial 200 in a closed configuration so that the annular lip 220 of the locking tab 260 is engaging the annular slit 120 cut through the cap 100. As shown indicator 159 and indicator 259 are lined up in position such that the push-tab 110 is over the position of the annular lip 220 and the locking tab 260. When the push-tab 110 is manually depressed, an inner surface of the push-tab 110 comes into contact with the annular lip 220 causing the locking tab 260 to flex inwardly. As the locking tab 260 flexes inwardly, the annular lip 220 disengages the annular slit 120 and the cap 100 may then be removed from the vial 200 by pulling or twisting it off.

Figure 6:
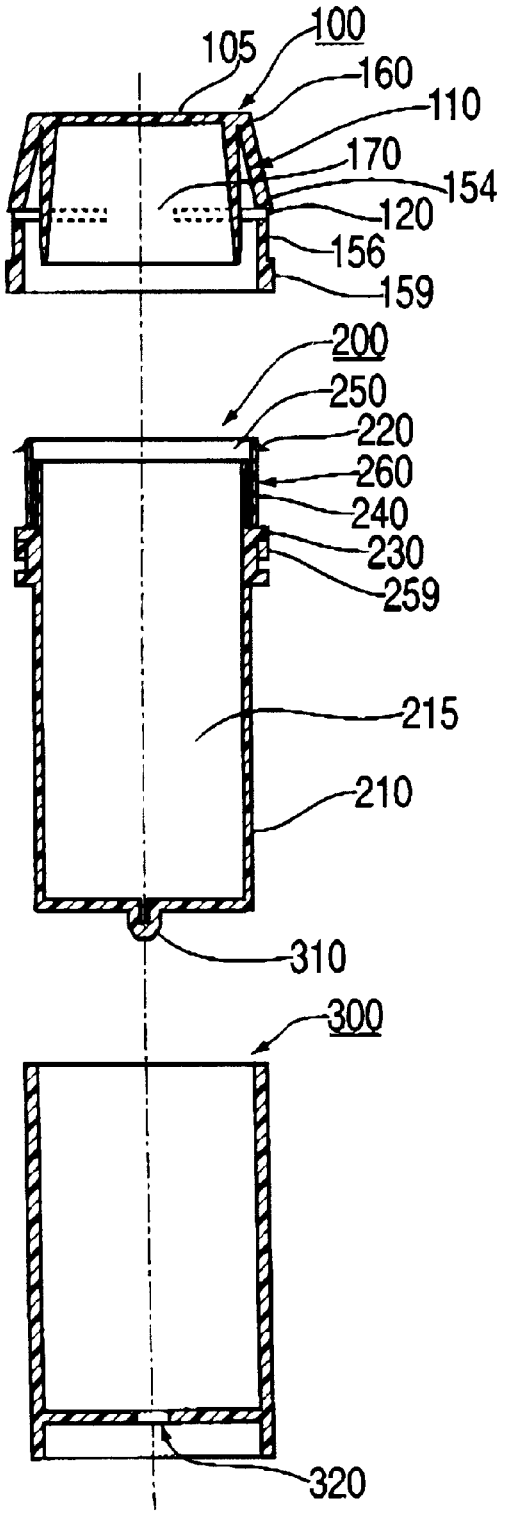
FIG. 6 illustrates a cut-away side view of the cap and vial, the vial contained in an outer vial, according to another embodiment of the present invention.

Referring to FIG. 6, the vial 200 may be configured as an inner rotating vial 200 which fits into an outer rotating vial 300. The inner rotating vial 200 is connected to the outer rotating vial 300 by means of a snap plug 310 which fits into a snap hole 320. The snap plug 310 preferably is integrally connected at a bottom portion of the inner rotating vial 200, while the snap hole 320 is cut-through a bottom portion of the outer rotating vial 300. The snap plug 310 also preferably has a portion with a slightly wider circumference located away from the bottom portion of the inner rotating vial 200 to prevent accidental disengagement of the snap plug 310 from the snap hole 320. Thus the inner rotating vial 200 is snapped into the outer rotating vial 300 by inserting the snap plug 310 into the snap hole 320.

Referring to FIG. 7, the annular slit 120 is not cut entirely through the outer annular skirt 150 of the cap 100, but is preferably cut only partially into an inner surface of the outer annular skirt 150. Thus the outer surface of the outer annular skirt 150 around the complete circumference of the cap 100 can be an uninterrupted surface with the first part 154 of cap 100 being integrally connected to the second part 156 of cap 100 by the bridge 170. The annular slit 120 is cut deep enough into the inner surface to allow the annular lip 220 of the locking tab 260 to fully engage the annular slit 120 and thus lock the cap 100 into place on the vial 200. Furthermore, the annular slit 120 preferably extends around the complete inner circumference of the outer annular skirt 150, thus allowing for complete rotation of the cap 100 around the vial 200.

It is to be understood and expected that variations in the principles of construction herein disclosed in an embodiment may be made by one skilled in the art and it is intended that such modifications, changes, and substitutions are to be included with the scope of the present invention.

What is claimed is:

1. A child-resistant, adult-friendly cap and vial assembly, comprising:

a vial, the vial comprising:

a receptacle portion defining a storage chamber;

at least one annular platform projecting from the receptacle portion of the vial;

an inner annular flange projecting from the at least one annular platform and defining an opening for access to the chamber defined by the receptacle portion;

an outer flange projecting from the at least one annular platform at a position radially outward of the inner annular flange and extending circumferentially at least a portion of the at least one annular platform; and at least one locking tab, having a lip extending and projecting outwardly from an upper portion of the at least one locking tab, projecting from the at least one annular platform at a position radially outward of the inner annular flange; and a cap, the cap comprising:

a base;

an outer annular skirt, depending from the base and defining an opening into which the vial fits;

at least one push-tab cut into a circumference of the outer annular skirt and integrally connected near the base; and at least one slit, cut in the circumference of the outer annular skirt, for complementary engagement with the lip on the at least one locking tab of the vial;

wherein when the cap is placed onto the vial the lip located on the at least one locking tab fits into the at least one slit cut in the cap, thereby preventing the cap from being pulled off of the vial.

2. The child-resistant, adult-friendly cap and vial assembly according to claim 1, wherein the cap can be removed from the vial by manually manipulating the at least one push-tab on the cap such that the at least one push-tab causes the at least one locking tab to flex enough to remove the lip from the at least one slit in which it rested.

3. The child-resistant, adult-friendly cap and vial assembly according to claim 1, wherein the cap further comprises:

an inner annular skirt, depending from the base, for closely fitting into the inner annular flange of the vial.

4. The child-resistant, adult-friendly cap and vial assembly according to claim 1, further comprising:

an outer rotating vial into which the vial fits.

5. The child-resistant, adult-friendly cap and vial assembly according to claim 4, wherein the vial is secured to the outer rotating vial by a snap plug which fits into a snap hole cut through the outer rotating vial.

6. The child-resistant, adult-friendly cap and vial assembly according to claim 1, wherein the at least one slit is cut through to an outer surface of the outer annular skirt of the cap.

7. The child-resistant, adult-friendly cap and vial assembly according to claim 1, wherein the at least one slit is cut partially into an inner surface of the outer annular skirt of the cap.

8. The child-resistant, adult-friendly cap and vial assembly according to claim 1, further comprising:

at least one bridge for joining a first part of the outer annular skirt to a second part of the outer annular skirt separated by the at least one slit.

9. The child-resistant, adult-friendly cap and vial assembly according to claim 1, wherein the vial and cap are made of plastic.

* * * * *

UNITED STATES PATENT AND TRADEMARK OFFICE

CERTIFICATE OF CORRECTION

Figure 7A:
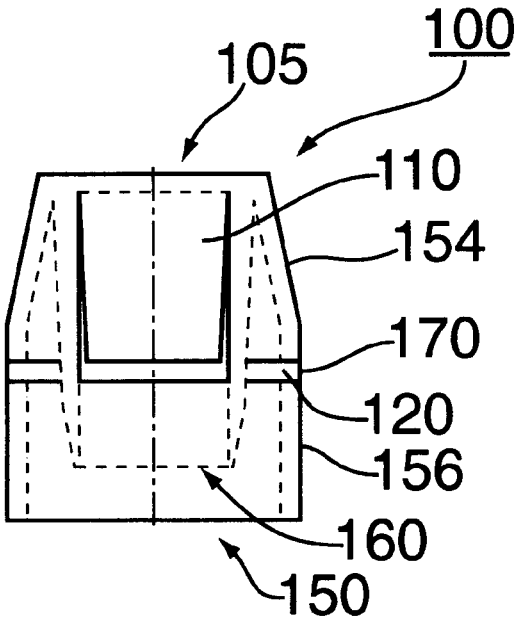
FIG. 7 illustrates a side view and a cut-away view of the cap, according to another embodiment of the present invention.
Figure 7B:
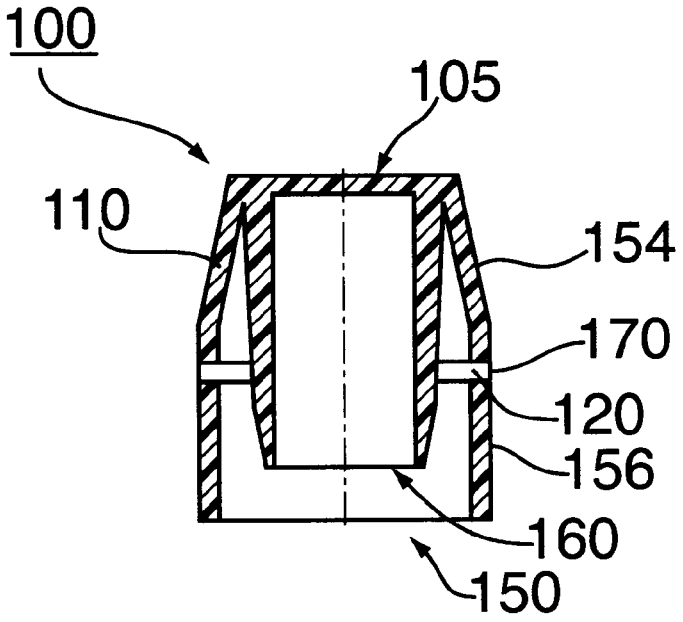

PATENT NO. : 5,979,680
DATED : November 9, 1999
INVENTOR(S) : Nicholas C. Farside It is certified that error appears in the above-identified patent and that said Letters Patent is hereby corrected as shown below:

Column 3,
Line 17, change "FIG. 7 illustrates" to read -- FIGS. 7A and 7B illustrate --.

Signed and Sealed this

Fifth Day of February, 2002

*Attest:*

*Attesting Officer*

JAMES E. ROGAN
*Director of the United States Patent and Trademark Office*